US006016942A

United States Patent [19]

Allen

[11] Patent Number: 6,016,942

[45] **Date of Patent: *Jan. 25, 2000**

[54] ROTATABLE WRIST MOUNT SPECIAL RECEPTACLE

[76] Inventor: Robert P. Allen, 18734 Hwy. 30, #18, Hagerman, Id. 83332

[ * ] Notice: This patent issued on a continued prosecution application filed under 37 CFR 1.53(d), and is subject to the twenty year patent term provisions of 35 U.S.C. 154(a)(2).

[21] Appl. No.: 09/058,998

[22] Filed: Apr. 13, 1998

[51] Int. Cl.[7] ..... A63B 69/00

[52] U.S. Cl. ..... 224/197; 224/219; 434/250

[58] Field of Search ..... 224/197, 199, 224/219, 222, 267; 434/250

[56] References Cited

U.S. PATENT DOCUMENTS

| | | | |
|---|---|---|---|
| 1,407,239 | 2/1922 | Weiss | 224/219 |
| 2,099,295 | 11/1937 | Canfield | 224/255 |
| 3,550,824 | 12/1970 | Bohanski | 224/219 |
| 4,903,932 | 2/1990 | Stewart, Jr. | 224/267 |
| 5,386,933 | 2/1995 | Greene et al. | 224/219 |
| 5,531,481 | 7/1996 | Wiltshire | 224/219 |
| 5,810,220 | 9/1998 | Peterson | 224/222 |

FOREIGN PATENT DOCUMENTS

| | | | |
|---|---|---|---|
| 70777 | 2/1916 | Switzerland | 224/219 |

*Primary Examiner*—Stephen P. Garbe

[57] ABSTRACT

A special receptacle which mounts on a user's wrist for holding and displaying visual aids as used by ice skaters.

14 Claims, 2 Drawing Sheets

ROTATABLE WRIST MOUNT SPECIAL RECEPTACLE

STATEMENT REGARDING FEDERALLY SPONSORED RESEARCH OR DEVELOPMENT

Not applicable.

REFERENCE TO MICROFICHE APPENDIX

Not Applicable.

BACKGROUND OF THE INVENTION

1. Field of the Invention

This invention relates to the field of ice dancing. Prior to this invention, skaters, during practice, would frequently carry in their hands visual aids which help them learn their routines. The visual aids were usually comprised of diagrams and instructions which had been extracted from books.

2. List of Related Art cited

| | | | |
|---|---|---|---|
| 1,407,239 | 2/1922 | Weiss | 224/219 |
| 5,810,220 | 9/1998 | Peterson | 224/222 |
| 2,099,295 | 11/1937 | Canfield | 224/255 |
| 3,550.824 | 12/1970 | Bohanski | 224/219 |
| 5,386,933 | 2/1995 | Greene et al. | 224/219 |
| 5,531,481 | 7/1996 | Wiltshire | 224/219 |
| 5,810,220 | 9/1998 | Peterson | 224/222 |
| 4,903,932 | 2/1990 | Stewart, Jr. | 224/267 |

DESCRIPTION OF THE RELATED ART

The reference documents are related to the application of this invention in that several pertain to a device for holding something on a wrist. Differences from the subject invention which are common to each of the references is that none of them in their specific styles or size proportions are capable of safely holding for display to a skater moving at the pace of music, the set of ice dance diagram cards especially designed for the subject holder.

The foreign patent of 1916 by Maisch of Switzerland is for a leather wrist mount sketch and note pad holder with pencils. Had the designer intended to display individual printed graphics he could have if he would have sized such displays to fit his holder. However his holder concept would not accept the size and the stacked set of graphic cards that the subject invention is designed for, and his holder does not provide for rotatable viewing orientation as required of the dance graphics designed for the subject invention device.

The U.S. 1922 patent by Weiss is for a wrist mount holder for paper or erasable reusable surface note pad with pencil, and an openable windowed protective cover for writing through the windows. The concept did not contemplate holding otherwise printed graphics or stacks of such as provided for by the subject invention device.

The U.S. 1937 patent by Canfield is for a wrist mount holder for miniature paper note pads from which used sheets can be removed. The concept did not contemplate holding otherwise printed graphics or stacks of such as provided for by the subject invention device.

The U.S. 1970 patent by Bohanski is for a wrist mount rotatable holder for flashlights. The wrist mount purpose is similar to the hands freeing function of the subject invention device. And the rotatable purpose is similar to the direction orienting function of the subject invention device, except that Bohanski's rotation is held in increments of orientation by a circle of spaced mechanical bumps on its mount plate, whereas the rotation of the subject invention device is infinite as to position setting. The rotatable position hold function of the subject invention is considered to be an improvement over Bohanski's concept and that of other rivet and nut/bolt types of rotation fastenings of holders to wrist mounts, for the following reasons. The invention device any position holding functions through the close mating and surface friction between four relatively large diameter disk surfaces that are part of the wrist mount to holder assembly, as will be further explained below and through the drawings. Also the large diameters of the disks and their large diameter joining stem provide strong fastening strength, with parts that do not tear out of plastic surfaces with use such as normal diameter metal rotational fasteners can.

The U.S. 1990 patent by Stewart is for a thigh mounted holder for such as relatively large writing tablet clip boards used while seated. That the tablet holder rotates is a principal feature of the device. Eight optional position direction positions are available. The position locking device and the mount to holder fastening are strong, related to the large clip board and the strength of a leg thigh. The mechanisms are too strong and too elaborate relative to the simple light weight parts of the subject invention graphic cards holder for use on wrists.

The U.S. 1995 patent by Greene is for mounting protectively transparent laminated ski run area maps on wrists. The laminated sandwich has cuts in the back sheet which accept wrist mounting straps. The sandwich flex curves over the wrist and its clothing. Similar to what professional football quarterbacks and coaches are presently using for play referencing. Ice dance diagrams could be individually handled with such a concept, but not equivalent to the subject invention holder with its stacking capacity, clearer to read non-covered graphics, and rotatable features.

The U.S. 1996 patent by Wiltshire is for a small in area but relatively high miniature wrist mount memo pad device with pencil. The height of the device relates to its having a stack of miniature file drawers for storing miniature writing paper and written memos. There are several additional elaborate features on this device, but none that would reasonably relate to the for learning aid graphic display features of the subject invention holder.

The U.S. 1998 patent by Petersen is for a small portable sorting tray for mail workers. The tray mounts on the underside of a forearm above the wrist and is rotatable. The tray mounted on the underside of the forearm permits the hand on that arm to participate in holding letter envelope sorting. A metal bolt with washers fastens the tray to the arm mount and brake holds rotation through its providing compression between mating surfaces. This fastener/position holding method is mechanically natural and is similar to that used for early versions of the subject invention holder. The present design for the rotation and fastening of the subject holder is a significant improvement, as outlined under patent by Bohanski above.

The above reference documents are indirectly related to the application of this invention in that several pertain to a device for holding something on a wrist. None of their designs are capable of displaying specially designed graphic cards to a skater moving at the pace of music. The invention's open face display, unique rotate mechanism, display holding living hinge tabs, and light weight plastic capable of withstanding ice rink conditions, are improvements over the indirect references.

BRIEF SUMMARY OF THE INVENTION

The present invention comprises a rotatable, wrist-mountable holder which receives visual aid diagrams for people learning to dance on ice skates. The holder can hold one or more sets of visual aids, such as cards having dance patterns printed on them, thus freeing the hands of the skater while practicing. The holder can be rotated on the skater's wrist to orient an ice pattern diagram to correspond with the ice rink geometry and the skater's position on the ice. In addition, the holder allows the visual aids to be changed with one hand when the holder is mounted on a user's wrist. All of the corners of the holder are rounded so that it has no sharp edges.

DETAILED DESCRIPTION OF THE INVENTION

Figure 1:
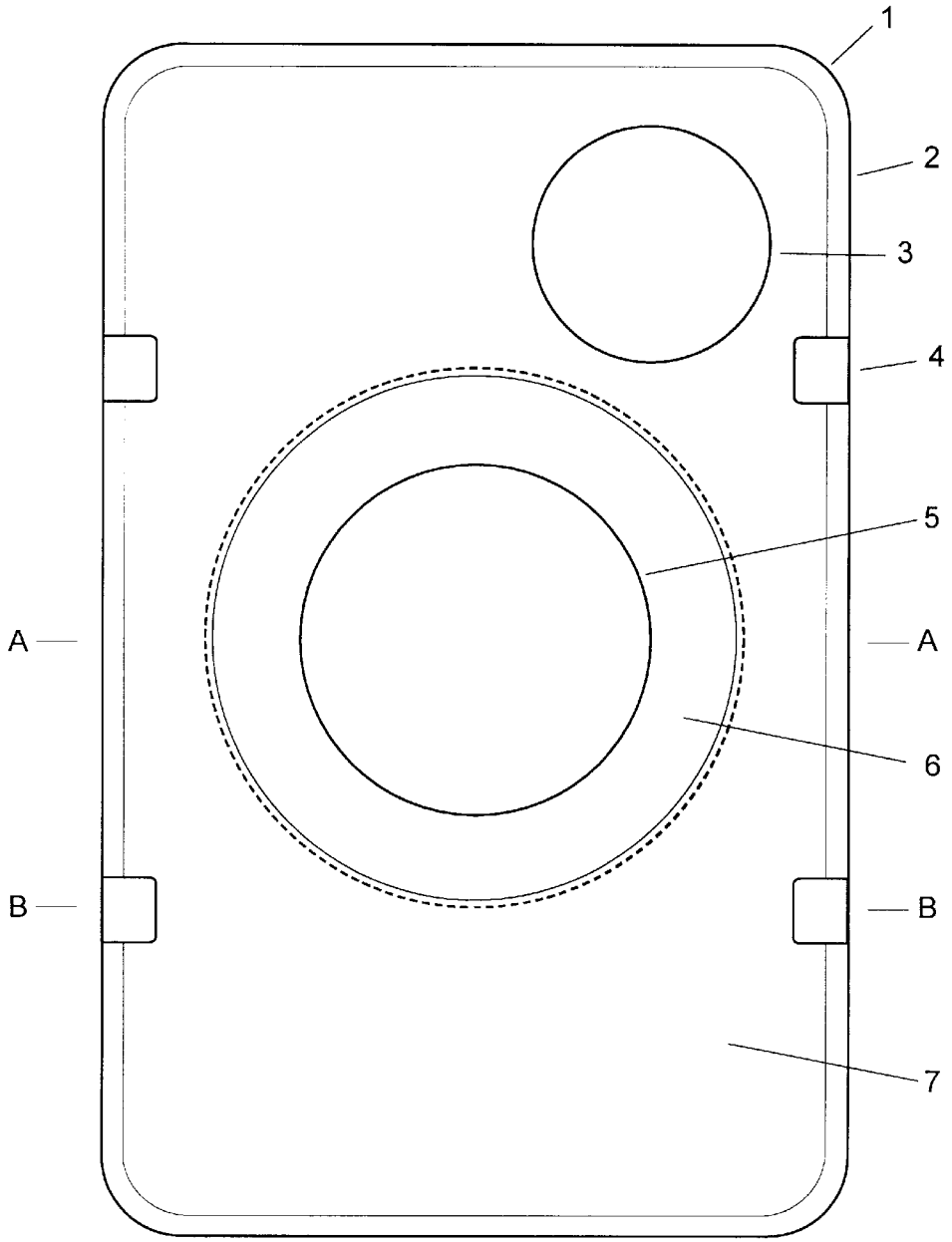
FIG. 1 is a plan view of the holder looking at it from its open top.

Holder 1 (FIG. 1) is formed from injection molded, shatterproof plastic material having self-hinge properties. The material is not brittle and not extremely rigid and may be either clear or colored. Holder 1 further includes side walls 2, tabs 4, and a bottom wall 7. The holder is attachable to a person's wrist by means of a wrist mount assembly 25 (FIG. 4) which is rotatably mounted to the holder through hole 5 in the bottom wall. The presently preferred sizing of the holder is for a set of 4"×6.5" corner rounded cards which set may be a stack up to ½" thick. The presently preferred thickness of the side walls is ⅛" for safety.

Figure 2:
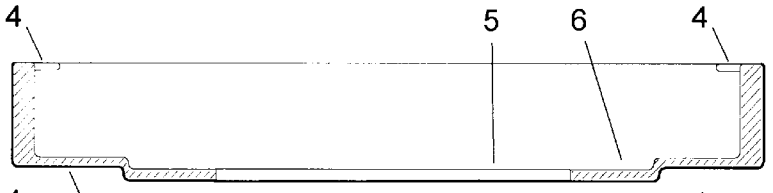
FIG. 2 is a cross section through line A—A in FIG. 1.
Figure 3:
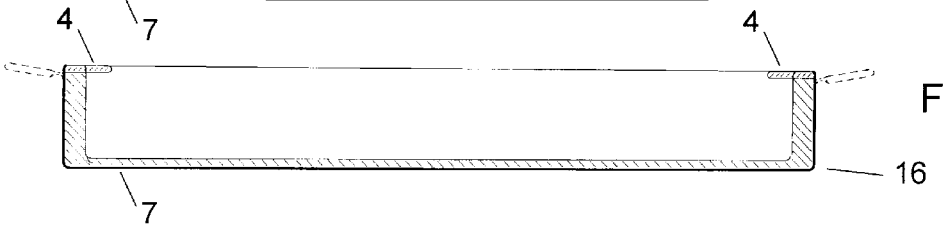
FIG. 3 is a cross section through line B—B in FIG. 1.

Tabs 4 (FIGS. 1–3) are hingedly attached to the upper edges of the side walls 2 by living hinges and loosely contain, for easy placement and removal, properly sized visual aid contents of the holder. The visual aids may take the form of 4 inch by 6.5 inch plastic cards having rounded corners and having patterns of ice dances printed on them. The tabs snap into recesses in the top edges of side walls 2. When closed they project into the holder over the edges of the contents. FIG. 3 illustrates the tabs in their closed positions in solid lines and in their open positions in broken lines.

Each of the vertical comers 1 (FIG. 1) of the side walls is curved, and all edges are rounded, as seen for example at 11 in FIG. 3. Bottom wall 7 includes a finger hole 3 (FIG. 1) which facilitates removal of the visual aids from the holder.

Figure 4:
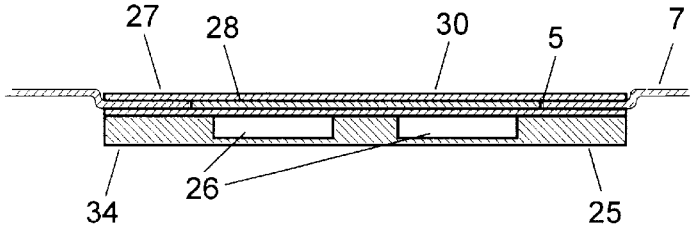
FIG. 4 is a cross section through the mount assembly when it is secured to the bottom wall.

Hole 5 in the bottom wall of the holder allows for attachment of the wrist mount assembly 25 (FIG. 4). The hole is located within a dimple 6 illustrated in FIGS. 1 and 2. Dimple 6 is a recess which allows the wrist mount assembly to rotate beneath the visual aid contents.

Figure 5:
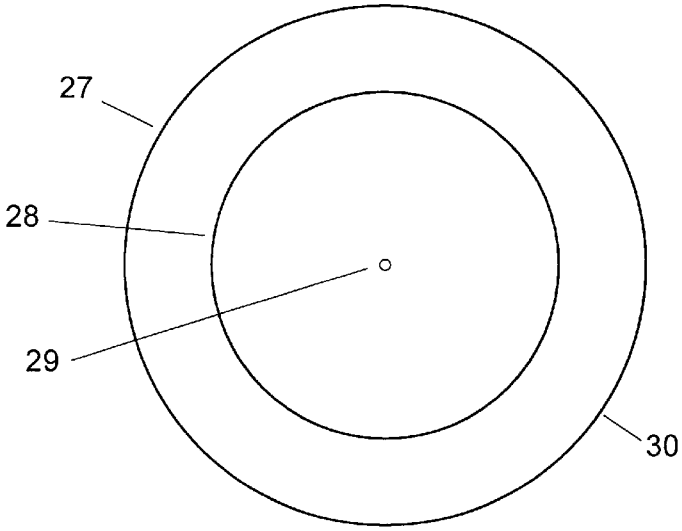
FIG. 5 is a plan view of the rivet swivel.
Figure 6:
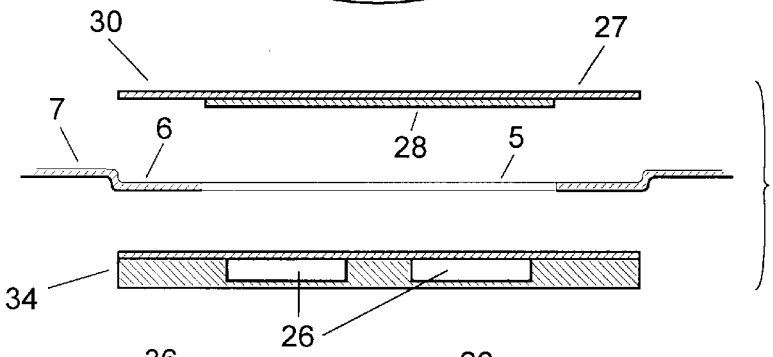
FIG. 6 is an exploded view of the rivet mount assembly and the bottom wall.

Wrist mount assembly 25 comprises a strap plate 34 (FIGS. 4 and 6–8), which is molded with or bonded to, disk 36, and a rivet swivel 30 (FIGS. 5 and 6), which is comprised of a rivet head 27 and a rivet stem 28. The wrist mount assembly is made from the same material as the holder and may be either injection molded or formed from sheets of plastic bonded together. The rivet stem 28 and the disk 36 are bonded together through hole 5 in the bottom wall 7. Friction between the mount assembly and the bottom wall of the holder is sufficient to maintain the holder in a set position but allows the holder to be rotated by hand. Each element of the wrist mount assembly includes a small centering hole 29 for facilitating accurate positioning of the mount parts prior to bonding.

Figure 7:
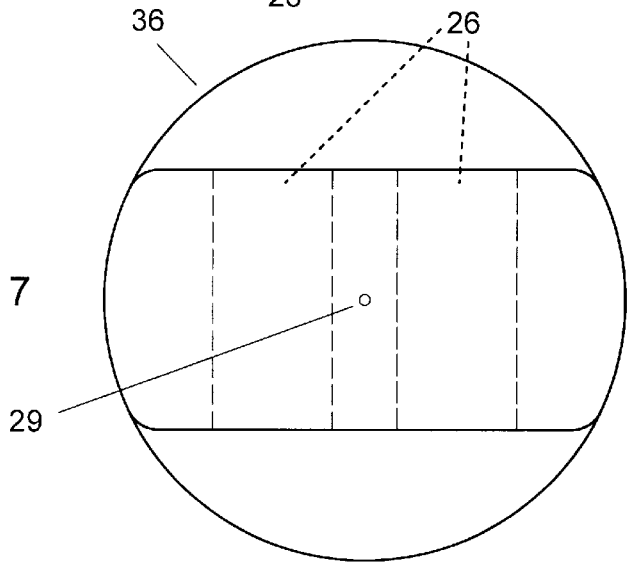
FIG. 7 is a plan view of the strap plate and the disk.
Figure 8:
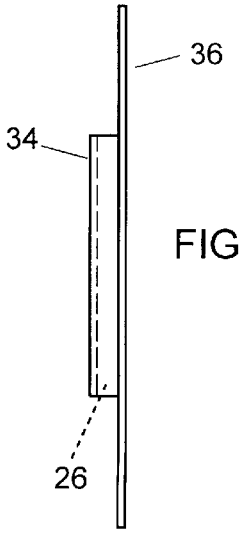
FIG. 8 is an edge view of the strap plate and disk of FIG. 7.

Strap plate 34 has curved ends which match the curvature of disk 36, as seen in FIG. 7. The strap plate includes slots 26 (FIGS. 4, 6, 7 and 8) for receiving a pair of straps or bands for attaching the holder to a user's wrist. The straps or bands may be made from various materials such as leather, nylon, or hook and loop fasteners.

In use, tabs 4 are moved to their open positions and visual aid contents are inserted into the holder. Tabs 4 are then snapped into their closed positions above the contents. Wrist straps are inserted through slots 26 in strap plate 34 and the holder is attached to the wrist of a user. The straps may be applied directly to the user's wrist or may be applied over the sleeve of the user's apparel.

What is claimed is:

1. A holder and wrist mount assembly for attaching to a user's wrist while practicing an ice dancing routine comprising:

a holder for receiving visual aids, said holder having a bottom wall and a plurality of substantially vertical side walls extending around the perimeter of the bottom wall, a plurality of tabs hingedly attached to the side walls and extending inwardly of the holder, said tabs being movable between an open position in which visual aids may be inserted into the holder and a closed position in which the tabs will prevent visual aids contained in the holder from falling out, a wrist mount assembly rotatably secured to the holder through a hole in the bottom wall, the assembly including a strap plate mounted to a disk and positioned under the bottom wall of the holder with the disk adjacent the bottom wall, the strap plate further including a slot extending through it for receiving a wrist strap, the wrist mount assembly further including a rivet swivel located inside the holder and secured to the disk through the hole.

2. The holder of claim 1 in which the holder and wrist mount assembly are made from molded plastic.

3. The holder of claim 1 in which the strap plate includes two slots for receiving two wrist straps.

4. The holder of claim 1 in which the bottom wall includes a finger hole.

5. The holder of claim 1 in which the tabs are hingedly connected to the side walls by living hinges.

6. The holder of claim 1 in which the rivet swivel includes a rivet head and a rivet stem secured together and wherein the rivet stem is secured to the disk.

7. The holder of claim 1 in which the bottom wall includes a finger hole, the tabs are hingedly connected to the side walls by living hinges, the rivet head swivel includes a rivet head and a rivet stem, and the rivet stem is secured to the disk.

8. The holder of claim 7 in which the holder and wrist mount assembly are made from molded plastic.

9. The holder of claim 1 in which the hole extends through the dimple in the bottom wall.

10. The holder of claim 9 in which the bottom wall includes a finger hole, the tabs are hingedly connected to the side walls by living hinges, the rivet swivel includes a rivet head and a rivet stem, the rivet stem is secured to the disk, and the rivet head is located within the dimple.

11. The holder of claim 9 in which the rivet swivel includes a rivet head and a rivet stem, the rivet stem is secured to the disk, and the rivet head is located within the dimple.

12. The holder of claim 11 in which the strap plate includes two slots for receiving two wrist straps.

13. The holder of claim 11 in which the bottom wall includes a finger hole.

14. The holder of claim 11 in which the tabs are hingedly connected to the side walls by living hinges.

* * * * *